United States Patent [19]

Küelzer

[11] 4,197,025

[45] Apr. 8, 1980

[54] DEVICE FOR GUIDING THE PAPER IN PAPER TRANSPORT IN PRINTERS, IN PARTICULAR TELEPRINTERS

[75] Inventor: Peter Küelzer, Munich, Fed. Rep. of Germany

[73] Assignee: Siemens Aktiengesellschaft, Berlin and Munich, Fed. Rep. of Germany

[21] Appl. No.: 888,648

[22] Filed: Mar. 21, 1978

[30] Foreign Application Priority Data

Mar. 25, 1977 [DE] Fed. Rep. of Germany ..... 2713333

[51] Int. Cl.[2] ..... B41J 11/60

[52] U.S. Cl. ..... 400/647.1; 400/637; 400/578

[58] Field of Search ..... 400/608, 618, 619, 637, 400/647, 647.1, 613.3, 578

[56] References Cited

U.S. PATENT DOCUMENTS

| | | | |
|---|---|---|---|
| 1,217,112 | 2/1917 | Gibson | 400/637 X |
| 1,332,263 | 3/1920 | Kurowski | 400/647 X |

FOREIGN PATENT DOCUMENTS

| | | | |
|---|---|---|---|
| 258708 | 4/1913 | Fed. Rep. of Germany | 400/608 |
| 1218473 | 6/1966 | Fed. Rep. of Germany | 400/618 |

OTHER PUBLICATIONS

IBM Technical Disclosure Bulletin, "Paper Table Actuated Feed Rollers and Paper Gate", Klein et al., vol. 17, No. 5, Oct. 1974, pp. 1263–1264.

*Primary Examiner*—Ernest T. Wright, Jr.
*Attorney, Agent, or Firm*—Matthew L. Ajeman

[57] ABSTRACT

In the illustrated embodiment, a guide element is provided in advance of the platen-pressure roller gap for the purpose of preventing creasing of thin papers during transport. The guide element may have a retracted position providing for unobstructed movement of the paper leading edge along an insertion channel and into the platen-pressure roller gap. Then during paper transport by the platen, the guide element is shifted to an active position for deflecting the paper toward the platen such that the paper contacts the platen in advance of the pressure roller over a substantial angle (e.g. 15°–20°). A spring for urging the guide element to active position may have a spring force more insufficient to substantially deflect thick types of paper not subject to creasing.

2 Claims, 2 Drawing Figures

DEVICE FOR GUIDING THE PAPER IN PAPER TRANSPORT IN PRINTERS, IN PARTICULAR TELEPRINTERS

BACKGROUND OF THE INVENTION

The invention relates to a device for guiding the paper in paper transport in printers, in particular in teleprinters, wherein the paper is guided about a platen which is moved by a feed device and is pressed against the platen by pressure rollers.

In teleprinters it is known to guide the paper around the platen by providing a paper trough which extends at a short distance along the entire width and a part of the periphery of the platen. The paper trough also simplifies the insertion of paper. For a reliable feed of the paper, pressure rollers are provided which are tilted back when the paper is inserted and press the paper against the platen during the printing process. The paper is moved forwards by the feed motion of the platen. However, these known devices cannot prevent the fact that when the paper is inserted between the platen and the pressure rollers, in the case of thin types of paper wavy deformations are formed which lead to the creasing of the paper during the further transportation. Fold-free transport meets with considerable difficulties. The known paper trough cannot be brought too close and as far as possible round the periphery of the platen, as this would considerably impede the insertion of the paper. A continuous pressure roller having a pressure force which is as uniform as possible over the width of the platen is virtually impossible to produce with a low outlay.

A device for guiding the paper in printing equipment during paper transport is known in which a paper insertion channel guides the paper in advance of the platen and has a guide element which deflects the paper from the motion direction during paper transport such that the paper already contacts the platen in front of the pressure rollers (U.S. Pat. No. 1,332,263). However, in this known device, the paper is also deflected while it is being inserted, and a paper guide trough is to be shifted away from the platen prior to insertion of the paper.

According to the present invention, the insertion of the paper is to be facilitated by avoiding such deflection during loading operation and furthermore difficulties which result when very thin paper is to be inserted into the gap between the platen and the pressure rollers are to be overcome.

SUMMARY OF THE INVENTION

The aim of the invention is to provide a particularly simple device for guiding the paper in paper transport, wherein even thin types of paper are satisfactorily transported and the insertion of the paper around the platen is not impeded. The aim is realized in accordance with the invention in that in front of the platen, along the width thereof,there is arranged a guide element which deflects the paper out of the direction of movement, during the feed motion before the platen is reached, in such manner that the paper contacts the platen in front of the pressure rollers.

The basic principle of the invention consists in that the paper, in its entire width, contacts the platen before the pressure rollers. Any guide element can be used to deflect the paper out of the direction of movement. The guide element is pivoted out of the paper channel by means of a control element during the insertion of the paper and pivoted into the direction of movement of the paper in the operating position. As a result, no wavy deformations are formed even in the case of thin types of paper. The guide element is active only during the paper transport. When the paper is inserted, the guide element is inactive so that the paper is not impeded. The realization of the fundamental principle is achieved particularly simply and cost-favorable. The realization of the invention can also be subsequently incorporated into existing printers and teleprinters.

A particularly simple and cost-favorably exemplary embodiment is achieved in that the guide element consists of a pivotable shutter which is biased by a spring and which can be controlled by a mobile cam. When the paper is inserted, the cam assumes the rest position in which the shutter is pivoted behind the contour of the paper insertion channel. During the paper transport, the cam assumes the operating position in which the shutter deflects the paper out of the direction of movement in front of the platen.

To ensure that only thin types of paper are deflected, in an advantageous exemplary embodiment the spring force of the spring with which the shutter deflects the paper out of the direction of movement is set to be such that only thin types of paper are deflected. This avoids thicker types of paper being unnecessarily curved which would lead to an obstruction of the paper transport.

Details of the invention will be explained on the basis of an advantageous exemplary embodiment which is illustrated in the accompanying sheet of drawing; other objects, features and advantages will be apparent from this detailed disclosure and from the appended claims.

DETAILED DESCRIPTION

Figure 1:
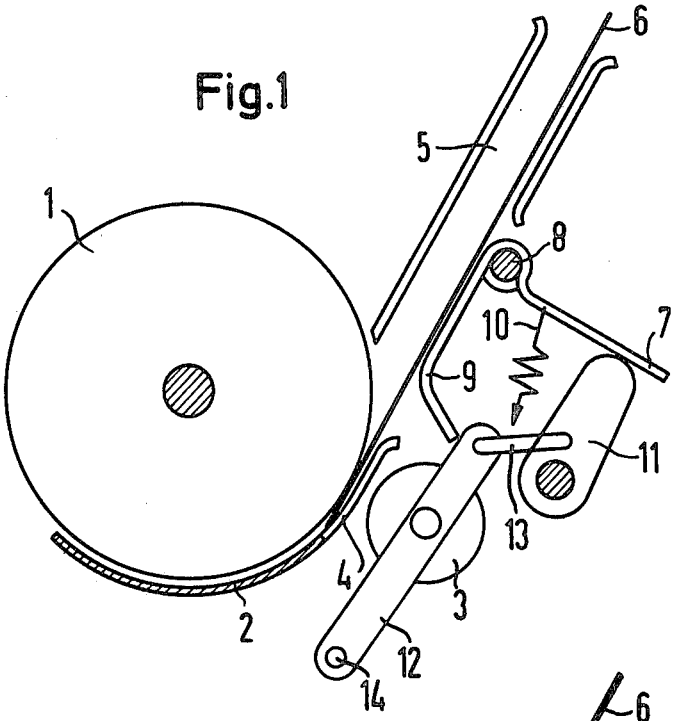
FIG. 1 shows the paper guidance device in the rest position.

FIG. 1 illustrates the device in accordance with the invention on the occasion of the insertion of a paper 6 towards the platen 1. A paper trough 2 leads over a part of the periphery of the platen 1, along the width thereof. On each side the paper trough 2 possesses an aperture 4 through which, during the feed process, the pressure rollers 3 press the paper 6 against the platen 1. In FIG. 1 the pressure rollers 3 are manually tilted into the rest position. The paper 6 is inserted through the paper channel 5 into the paper trough 2 and contacts a part of the periphery of the platen 1. The shutter 7 which is mounted to be mobile on the axis 8, having the width of the paper guidance, is arranged above the pressure rollers 3. The shutter 7 is biased by the spring 10 and the pivoting into the rest position or operating position is carried out with the mobile cam 11 acting as control element. When the paper 6 is inserted, the cam 11 assumes the position illustrated in FIG. 1. In this position, the back 9 of the shutter 7 is pivoted behind the contour of the paper channel 5. The paper 6 can be rapidly and simply inserted without obstruction. Controlling of the pressure rollers 3 in teleprinters is well known (i.e., U.S. Pat. No. 1,332,263). For controlling the mobile cam 11, there are arranged couple elements 12 and 13 between the pressure rollers 3 and the mobile cam 11. The couple elements 12, 13 are active only during controlling the pressure rollers 3 from rest position into operating position and back. The couple element 12 is mounted to be mobile on the axis 14.

Figure 2:
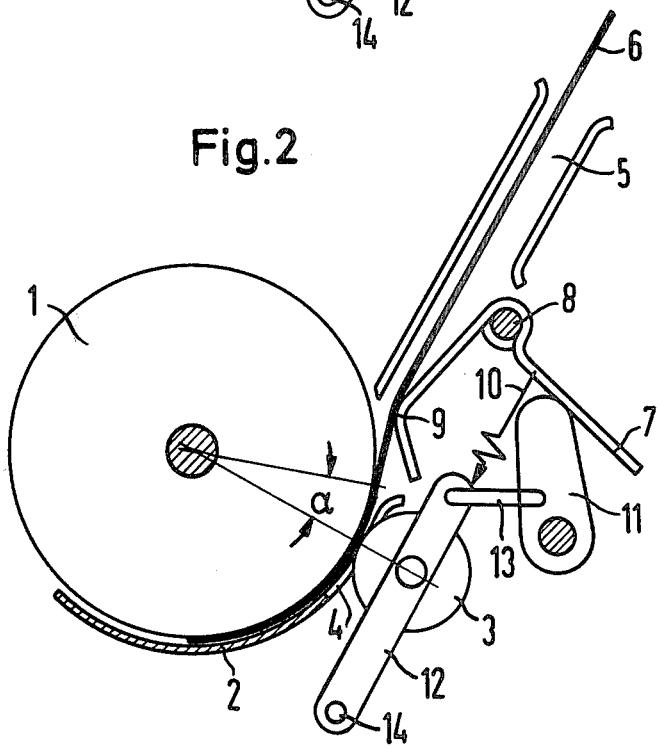
FIG. 2 shows the device in accordance with the invention in the operating position during the paper transport.

Following the insertion of the paper 6, the pressure rollers 3 are applied to the platen 1 through an aperture or apertures 4 in the paper trough 2. Then the operating position has been reached in which the paper 6 is advanced. This state is illustrated in FIG. 2. The cam 11 now assumes the position shown in FIG. 2. As a result of the spring force of the spring 10, the shutter 7 is pivoted into the other position in which the back 9 of the shutter 7 deflects the paper 6 out of the direction of movement. As a result of the deflection, the paper 6 is applied to the platen 1 over the angle $\alpha$ in front of the pressure rollers 3, and the stiffness of the paper 6 is increased as a result of the curvature. As a result, even with a greater lateral spacing of the pressure rollers 3, wavy formations of the paper 6 are prevented and a satisfactory advance of the paper 6 is ensured.

The spring force of the spring 10 is contrived to be such that only thin types of paper are deflected out of the direction of movement. Thicker types of paper which, on account of their greater stiffness, do not form wavy deformations, cannot be deflected by the back 9 of the shutter 7. This prevents a curvature of the thicker types of paper which would lead to an obstruction of the feed process.

It will be apparent that many modifications and variations may be effected without departing from the scope of the novel concepts and teachings of the present invention.

I claim as my invention:

1. A device for guiding paper during paper transport in printers, in particular teleprinters, including a platen around which the paper is guided, pressure roller means for pressing the paper against the platen during driving of the platen to advance the paper, a paper insertion channel for guiding the paper in a motion direction towards the platen, and a guide element arranged in front of the platen for deflecting the paper from the motion direction before the paper reaches the platen such that the paper contacts the platen in front of the pressure roller means, characterized in said guide element being in the form of a pivotable shutter (7, 9) pivotable from an operating position in which the shutter deflects the paper (6) from the motion direction during paper transport, to a rest position in which the shutter is pivoted behind the contour of the paper insertion channel (5) while the paper is being inserted so that the paper is inserted directly between the platen (1) and the pressure roller means (3), and control means (10, 11) for actuating the pivotable shutter (7, 9) between said operating position and said rest position, and operable for deactivating said pivotable shutter (7, 9) by placing the pivotable shutter in said rest position when the paper is to be inserted, and operable for bringing the pivotable shutter (7, 9) into the operative position when the paper is to be advanced by driving of the platen.

2. A device according to claim 1, characterized in that said control means comprises a spring (10) for biasing the shutter (7, 9) toward said operating position, the spring force of the spring (10) with the aid of which the shutter (7, 9) deflects the paper (6) from the motion direction being set to be such that only thin types of paper can be deflected.

* * * * *